US009905954B2

(12) United States Patent
Chan et al.

(10) Patent No.: US 9,905,954 B2
(45) Date of Patent: Feb. 27, 2018

(54) POWER TRANSMISSION DEVICE AND MANUFACTURING METHOD THEREOF

(71) Applicant: Delta Networks, Inc., Taoyuan City (TW)

(72) Inventors: I-Wen Chan, Taoyuan (TW); Shu-Hong Chu, Taoyuan (TW); Kuo-Shung Huang, Taoyuan (TW)

(73) Assignee: Delta Networks, Inc., Taoyuan (TW)

( * ) Notice: Subject to any disclaimer, the term of this patent is extended or adjusted under 35 U.S.C. 154(b) by 0 days.

(21) Appl. No.: 15/395,731

(22) Filed: Dec. 30, 2016

(65) Prior Publication Data

US 2017/0244188 A1 Aug. 24, 2017

(30) Foreign Application Priority Data

Feb. 24, 2016 (TW) ..... 105105382 A

(51) Int. Cl.

| | |
|---|---|
| ***H01R 12/00*** | (2006.01) |
| ***H01R 13/207*** | (2006.01) |
| ***H01R 12/71*** | (2011.01) |
| ***H01R 13/193*** | (2006.01) |
| ***H01R 13/405*** | (2006.01) |
| ***H01R 12/52*** | (2011.01) |
| ***H01R 12/70*** | (2011.01) |

(52) U.S. Cl.

CPC ..... *H01R 13/207* (2013.01); *H01R 12/52* (2013.01); *H01R 12/7047* (2013.01); *H01R 12/718* (2013.01); *H01R 13/193* (2013.01); *H01R 13/405* (2013.01); *H01R 12/7088* (2013.01)

(58) Field of Classification Search

CPC ..... H01R 13/207

USPC ..... 439/75, 212

See application file for complete search history.

(56) References Cited

U.S. PATENT DOCUMENTS 5,500,606 A * 3/1996 Holmes ..... G01R 1/07335 324/754.08

6,024,589 A * 2/2000 Hahn, IV ..... H05K 1/148 174/71 B 6,175,509 B1 * 1/2001 Koch ..... H05K 1/141 174/260

(Continued)

FOREIGN PATENT DOCUMENTS

TW 200731904 8/2007

TW M525006 U 7/2016

OTHER PUBLICATIONS

Search Report dated Nov. 21, 2016 in Taiwanese Patent Application No. 105105382.

*Primary Examiner* — Tulsidas C Patel

*Assistant Examiner* — Peter G Leigh

(74) *Attorney, Agent, or Firm* — Muncy, Geissler, Olds & Lowe, P.C.

(57) ABSTRACT

A power transmission device includes a first circuit board, a conductive base, a connection element, a second circuit board, and a fixing element. The conductive base is fixed on the first circuit board. The connection element is disposed on the conductive base. The second circuit board is fixed on the connection element. The fixing element is disposed on the second circuit board, and connected to the conductive base by penetrating through the second circuit board and the connection element. The first circuit board is electrically connected to the second circuit board via the conductive base and the connection element.

17 Claims, 10 Drawing Sheets

(56) References Cited

U.S. PATENT DOCUMENTS

| | | | | |
|---|---|---|---|---|
| 6,900,390 | B2 * | 5/2005 | Halter | H01B 7/0823 174/100 |
| 7,014,499 | B2 * | 3/2006 | Yoon | G01R 1/07378 324/756.03 |
| 7,164,279 | B2 * | 1/2007 | Strid | B82Y 15/00 324/73.1 |
| 7,352,168 | B2 * | 4/2008 | Dunklee | G01R 31/2887 324/756.02 |
| 7,425,144 | B2 * | 9/2008 | Bader | H01R 13/187 361/611 |
| 7,450,398 | B2 * | 11/2008 | Oh | H05K 1/148 361/749 |
| 7,775,819 | B2 * | 8/2010 | Bader | H01R 9/18 411/546 |
| 7,969,173 | B2 * | 6/2011 | Dunklee | G01R 31/2887 324/756.01 |
| 8,480,419 | B2 * | 7/2013 | Holbrook | B60R 25/00 174/72 B |
| 8,608,495 | B2 * | 12/2013 | He | H05K 7/1492 439/212 |
| 9,385,487 | B2 * | 7/2016 | Wu | H01R 12/73 |
| 2001/0005643 | A1 * | 6/2001 | Kalis | H01R 9/096 439/65 |
| 2003/0001254 | A1 * | 1/2003 | Jackson | H05K 3/3415 257/691 |

* cited by examiner

POWER TRANSMISSION DEVICE AND MANUFACTURING METHOD THEREOF

CROSS-REFERENCE TO RELATED APPLICATIONS

This Application claims priority of Taiwan Patent Application No. 105105382 filed on Feb. 24, 2016, the entirety of which is incorporated by reference herein.

BACKGROUND OF THE INVENTION

Field of the Invention

The present disclosure relates to a power transmission device, and in particular to a power transmission device for computer apparatuses.

Description of the Related Art

In general, computer apparatuses such as network servers need to consume large amounts of power, and power transmission devices are utilized to transmit the power supplied from power supplies to the mother boards of the computer apparatuses.

In general, a power transmission device includes many electronic components for power regulation and management. As shown in FIG. 1, the electronic components P30 of the power transmission device P1 are usually disposed on two circuit boards P10 and P20, which are stacked on each other, in order to properly take advantage of the internal space of the computer apparatus. Moreover, it is convenient for the maintenance of the power transmission device P1 by deposing the electronic components P30 on the circuit boards P10 and P20 since the current quantity of the power transmission device P1 is great.

In the conventional art, the power transmission device P1 utilizes the copper pillars P40 to support the upper circuit board P20 and separate circuit board P10 from circuit board P20. Moreover, there are two electrical connectors P50 respectively disposed on the circuit boards P10 and P20. The power transmission device P1 utilizes a wire P60 to connect to the electrical connectors P50.

Although power transmission devices have generally been adequate for their intended purposes, they have not been entirely satisfactory in all respects. Consequently, it is desirable to provide a solution for the problem of how to improve power transmission devices and decrease the cost of manufacturing.

BRIEF SUMMARY OF THE INVENTION

The present disclosure is to improve the power transmission device, and to decrease the manufacturing cost of the power transmission device.

The present disclosure provides a power transmission device, including a first circuit board, a conductive base, a connection element, a second circuit board, and a fixing element. The conductive base is fixed on the first circuit board. The connection element is disposed on the conductive base. The second circuit board is fixed on the connection element. The fixing element is disposed on the second circuit board, and connected to the conductive base by penetrating through the second circuit board and the connection element. The first circuit board is electrically connected to the second circuit board via the conductive base and the connection element.

The present disclosure provides a power transmission device, including a first circuit board, a first conductive base, a second circuit board, a second conductive base, a connection element, a first fixing element, and a second fixing element. The first conductive base is fixed on the first circuit board. The second circuit board is located over the first circuit board. The second conductive base is fixed on the second circuit board.

The connection element is connected to the first conductive base and the second conductive base. The first fixing element is connected to the first conductive base by penetrating through the connection element. The second fixing element is connected to the second conductive base by penetrating through the connection element. The first circuit board is electrically connected to the second circuit board via the first conductive base, the connection element, and the second conductive base.

In some embodiments, the power transmission device further includes a conductive material, and the second circuit board further includes a conductive layer. The conductive material is disposed on the conductive layer, and the connection element is connected to the conductive layer via the conductive material.

In some embodiments, the fixing element is conductive, and in direct contact with and electrically connected to the conductive base, the connection element, and the second circuit board.

In some embodiments, the power transmission device further includes a first connector and a second connector. The first connector is disposed on the first circuit board, and configured to connect a power supply. The second connector is disposed on the second circuit board, and configured to connect a mother board.

The present disclosure provides a manufacturing method of a power transmission device, including fixing a conductive base on a first circuit board; coating a conductive material on a conductive layer of a second circuit board and adjacent to a conductive hole of the second circuit board; disposing a connection element on the conductive material, and fixing the connection element on the second circuit board via the conductive material; putting the connection element on the conductive base; and fixing the second circuit board on the first circuit board by connecting the fixing element to the conductive base, wherein the fixing element penetrates through the second circuit board and the connection element. The first circuit board is electrically connected to the second circuit board via the conductive base and the connection element.

In some embodiments, the manufacturing method of the power transmission device further includes fixing a first connector and a first electronic component on the first circuit board; and fixing a second connector and a second electronic component on the second circuit board.

In conclusion, the power transmission device of the present disclosure utilizes the conductive base, the connection element, and the fixing element of the electrode structure to electrically connect two circuit boards, and to support the upper circuit board. Therefore, the electrical connectors that electrically connect two circuit boards in the conventional art can be replaced with the electrode structure of the present disclosure.

Moreover, the copper pillars in the conventional art can be replaced (or the number of copper pillars reduced) by the electrode structure of the present disclosure. Therefore, the manufacturing cost of the power transmission device is decreased.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
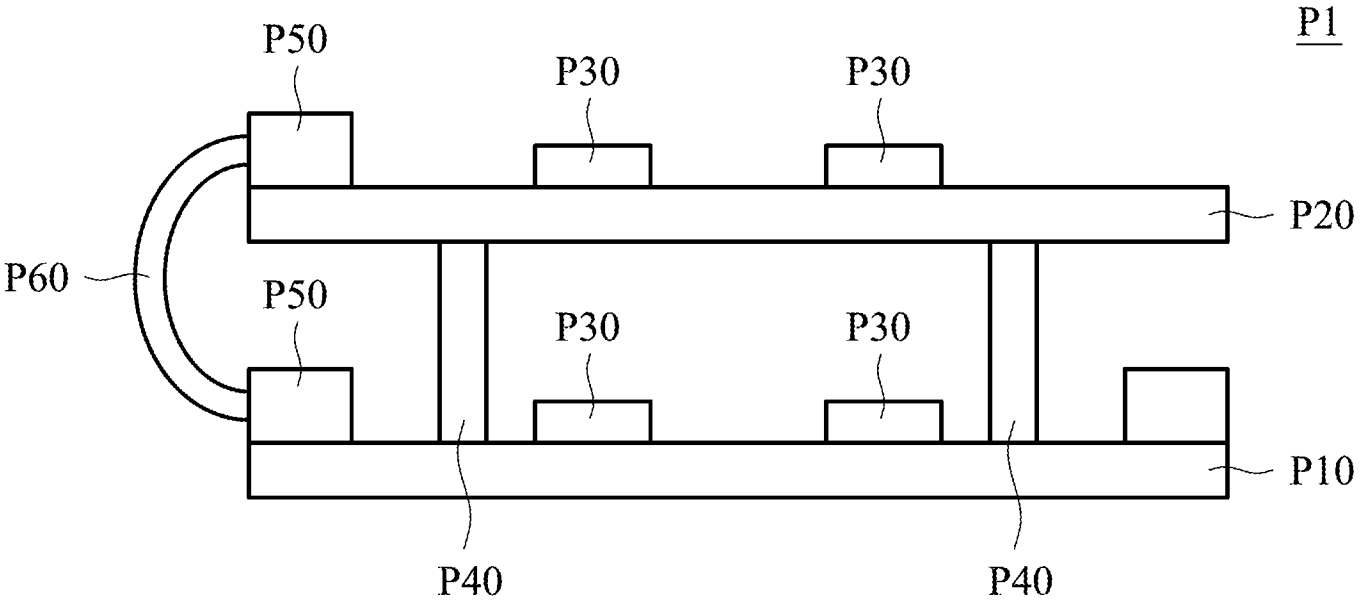
FIG. 1 is a schematic view of a conventional power transmission device.

The following disclosure provides many different embodiments, or examples, for implementing different features of the present disclosure. Specific examples of components and arrangements are described below to simplify the present disclosure. For example, the formation of a first feature over or on a second feature in the description that follows may include embodiments in which the first and second features are formed in direct contact, and may also include embodiments in which additional features may be formed between the first and second features, such that the first and second features may not be in direct contact.

In addition, the present disclosure may repeat reference numerals and/or letters in the various examples. This repetition is for the purpose of simplicity and clarity and does not in itself dictate a relationship between the various embodiments and/or configurations discussed.

The words, such as "first" or "second", in the specification are for the purpose of clarity of description only, and are not relative to the claims or meant to limit the scope of the claims. In addition, terms such as "first feature" and "second feature" do not indicate the same or different features.

The shape, size, and thickness in the drawings may not be drawn to scale or simplified for clarity of discussion; rather, these drawings are merely intended for illustration.

Figure 2:
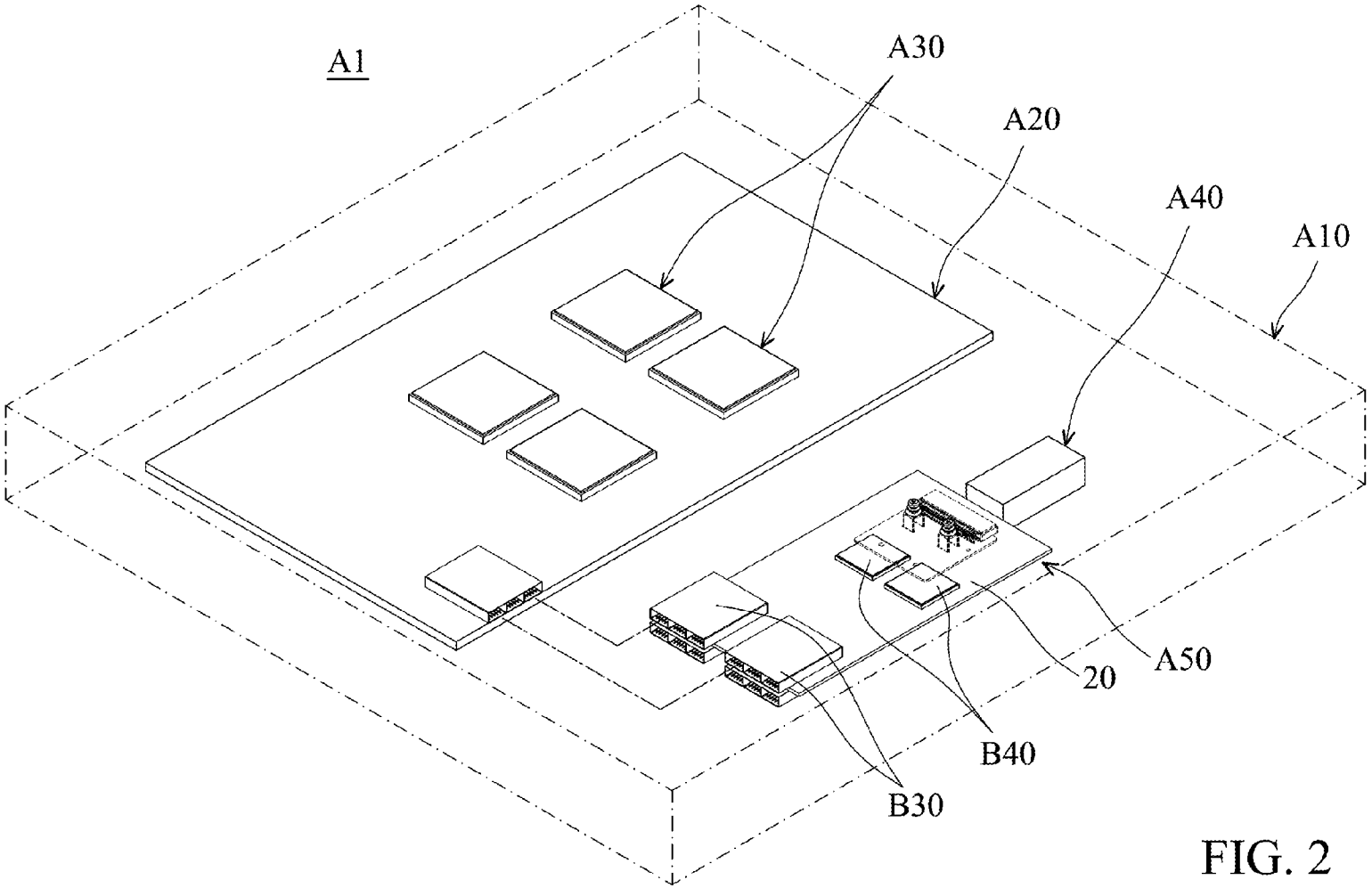
FIG. 2 is a perspective view of a computer apparatus in accordance with some embodiments of the present disclosure.

FIG. 2 is a perspective view of a computer apparatus A1 in accordance with some embodiments of the present disclosure. The computer apparatus A1 is a server, such as a network server. The computer apparatus A1 includes a casing A10, a mother board A20 main electronic components A30, a power supply A40, and a power transmission device A50. The mother board A20 is disposed in the casing A10. The main electronic components A30 are disposed on the mother board A20. The main electronic components A30 include a CPU, a display chip, and a memory, for example.

The power supply A40 is configured to supple power to the power transmission device A50. The power supply A40 is configured to convert alternating current to direct current, and transmit the direct current to the power transmission device A50. The power transmission device A50 is connected to the mother board A20 and the power supply A40.

The power transmission device A50 is configured to transmit the power supplied from the power supply A40 to the mother board A20. In some embodiments of the Power over Ethernet (PoE) switch, the power transmission device A50 is configured to regulate and reducing the voltage of the power and decrease the current quantity of the power supplied by the power supply A40, and afterwards to transmit the power to the mother board A20.

In some embodiments, the power supplied by the power supply A40 is 12V and 60 A. The power transmission device A50 converts the voltage of 12V to 5V, and transmits multiple current sets to the mother board A20 to supply suitable power to the main electronic components A30.

Figure 3:
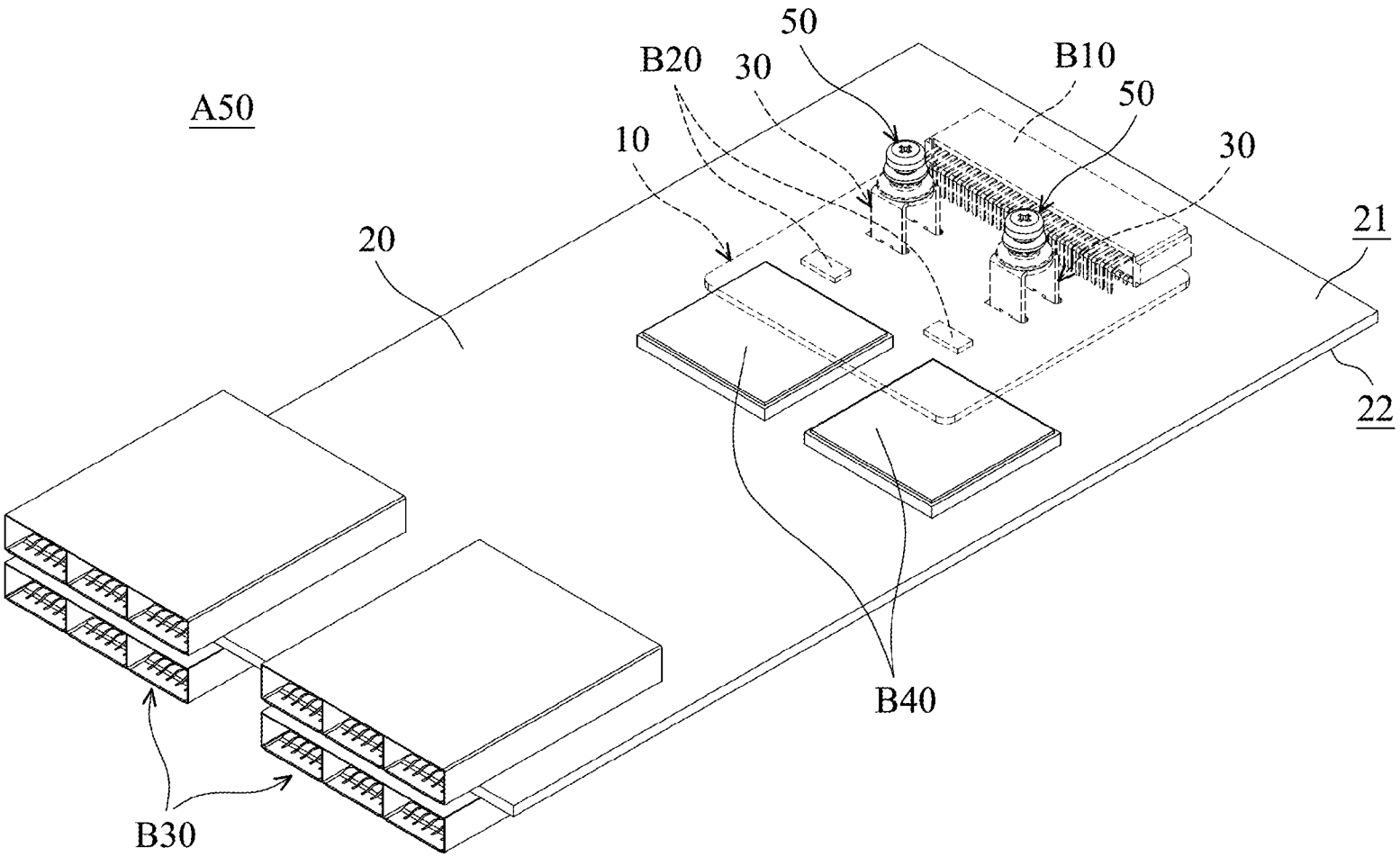
FIG. 3 is a perspective view of the power transmission device in accordance with a first embodiment of the present disclosure.
Figure 4:
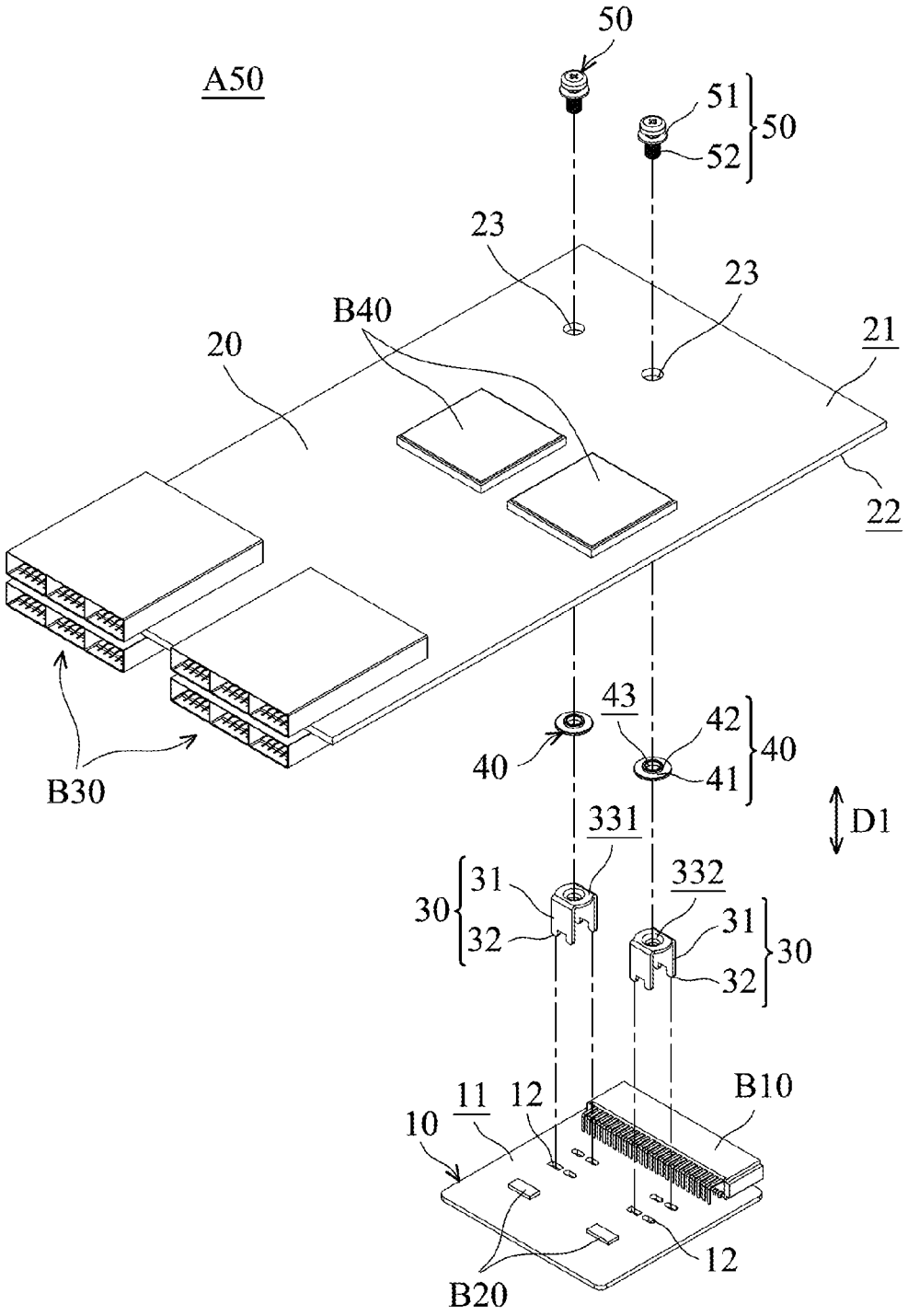
FIG. 4 is an exploded view of the power transmission device in accordance with a first embodiment of the present disclosure.
Figure 5:
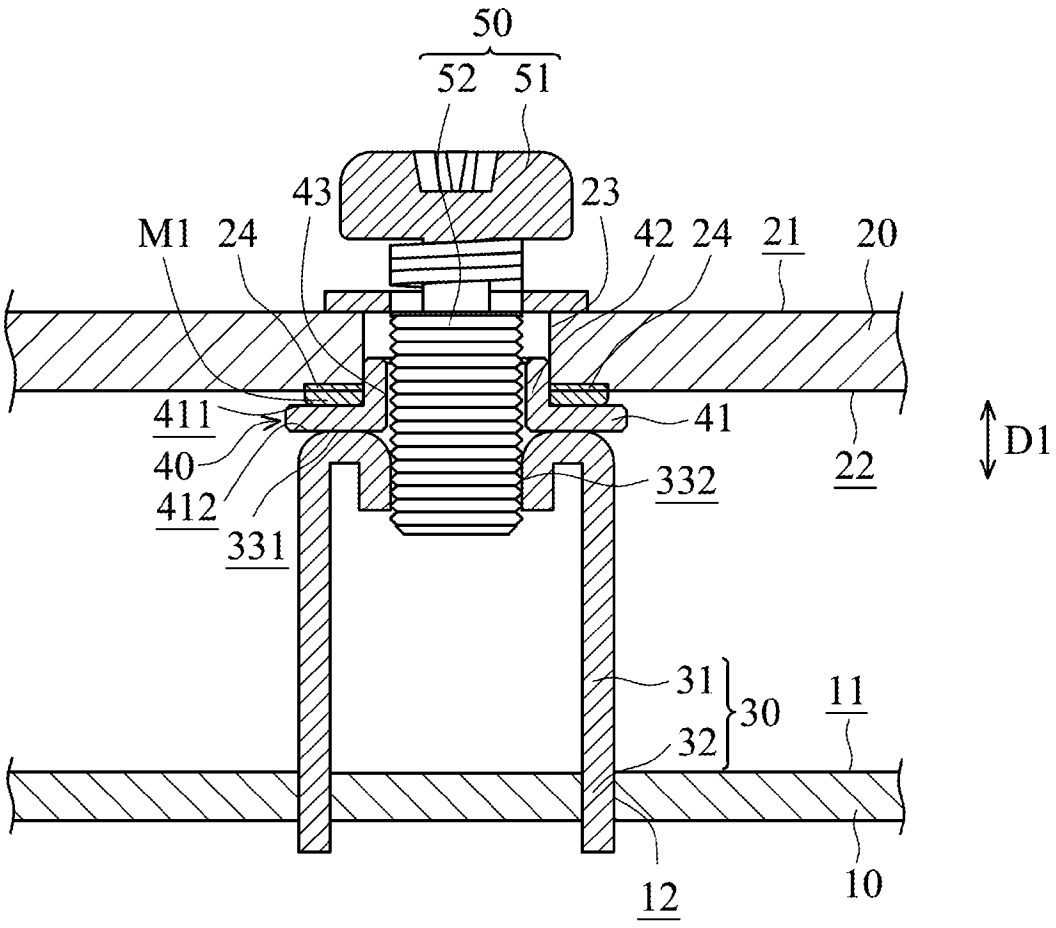
FIG. 5 is a cross-sectional view of the power transmission device in accordance with a first embodiment of the present disclosure.

FIG. 3 is a perspective view of the power transmission device A50 in accordance with a first embodiment of the present disclosure. FIG. 4 is an exploded view of the power transmission device A50 in accordance with a first embodiment of the present disclosure. FIG. 5 is a cross-sectional view of the power transmission device A50 in accordance with a first embodiment of the present disclosure. The power transmission device A50 includes a first circuit board 10, a second circuit board 20, two conductive bases 30, two connection elements 40, and two fixing elements 50.

The first circuit board 10 is separated from the second circuit board 20. In this embodiment, the first circuit board 10 is parallel to the second circuit board 20. The first circuit board 10, one conductive base 30, one connection element 40, one fixing element 50 are arranged in an arrangement direction D1.

In this embodiment, the power transmission device A50 further includes a first connector B10, first electronic components B20, second connectors B30, and second electronic components B40. The first connector B10 and the first electronic components B20 are disposed on the top surface 11 of the first circuit board 10. In this embodiment, the first connector B10 and the first electronic components B20 are directly fixed on and electrically connected to the first circuit board 10. The first connector B10 is electrically connected to the first electronic components B20 via the first circuit board 10.

The first connector B10 are configured to connect to the power supply A40 in FIG. 2. In other words, the power generated by the power supply A40 is transmitted to the first circuit board 10 via the first connector B10. For example, the first electronic component B20 is a voltage regulator, an over-current-protection element, a resistor, or a capacitor, for example.

In this embodiment, the conductive bases 30, the connection elements 40 and/or the fixing elements 50 form two electrode structures, wherein one of the two electrode structures is a positive electrode structure, and the other electrode structure is a negative electrode structure.

The second circuit board 20 is electrically connected to the first circuit board 10 via the electrode structures (the conductive base 30*s*, the connection elements 40 and/or the fixing elements 50). In other words, the power supplied by the power supply A40 is treated by the first electronic components B20, and then transmitted to the second circuit board 20 via the electrode structures.

In this embodiment, conventional electrical connectors that have a higher cost may be replaced with the electrode structures of the present disclosure to electrically connect the first circuit board 10 and the second circuit board 20. Therefor, the manufacturing cost of the power transmission device A50 is decreased.

The second connectors B30 and the second electronic components B40 are disposed on the top surface 21 of the second circuit board 20. In this embodiment, the second connectors B30 and the second electronic components B40 are directly fixed on and electrically connected to the second circuit board 20. The second electronic components B40 are electrically connected to electrode structure via the second circuit board 20.

The conductive base 30 is fixed on the first circuit board 10. The conductive base 30 is conductive, and made of conductive materials electrically connected to the first circuit board 10. In this embodiment, the conductive base 30 is a power terminal, and the conductive bases 30 are a positive conductive terminal and a negative conductive terminal.

The conductive base 30 includes a conductive body 31 and pins 32. The conductive body 31 has a top-conductive surface 331 and a retaining hole 332. In this embodiment, the top-conductive surface 331 is plane, and substantially parallel to the first circuit board 10. The top-conductive surface 331 is separated from the top surface 11. The retaining hole 332 is formed on the center of the top-conductive surface 331.

The pins 32 are connected to the conductive body 31, and the pins 31 and the conductive body 31 are formed as a single piece. The pins 32 are inserted to the inserting holes 12 of the first circuit board 10, and electrically connected to the first circuit board 10. The inserting holes 12 are formed on the top surface 11 of the first circuit board 10. In this embodiment, the pins 32 are welded on the first circuit board 10 to make the conductive base 30 to fix on the top surface 11 of the first circuit board 10.

The connection elements 40 are fixed on the second circuit board 20, and disposed on the conductive base 30. The connection element 40 is conductive, and made of conductive materials. The connection elements 40 are electrically connected to the second circuit board 20. In this embodiment, the connection elements 40 are SMD (surface mounted devices) nuts.

The connection element 40 includes a connection body 41 and a protrusion portion 42. The connection body 41 can be a plate structure, and has a top-connection surface 411 and a bottom-connection surface 412. The top-connection surface 411 is opposite to the bottom-connection surface 412. The protrusion portion 42 is disposed on the center of the top-connection surface 411. The connection body 41 further includes a connection hole 43 penetrating through the center of the connection body 41 and the protrusion portion 42.

In this embodiment, the top-connection surface 411 is substantially parallel to the bottom-connection surface 412, and the top-connection surface 411 and the bottom-connection surface 412 are flat surfaces. The bottom-connection surface 412 is in contact with the top-conductive surface 331. Since both of the bottom-connection surface 412 and the top-conductive surface 331 are flat surfaces, the connection element 40 is greatly electrically connected to the conductive base 30.

The top-connection surface 411 of the connection element 40 is in contact with the bottom surface 22 of the second circuit board 20, and the protrusion portion 42 is located in the conductive hole 23 of the second circuit board 20. In this embodiment, the bottom surface 22 faces the top surface 11 of the first circuit board 10.

In this embodiment, the second circuit board 20 further includes a conductive layer 24 located on the bottom surface 22 of the second circuit board 20. In some embodiments, the conductive layer 24 is also located on the side wall of the conductive hole 23 and/or the top surface 21.

In this embodiment, a conductive material M1 is located between the connection element 40 and the second circuit board 20. In other words, the conductive material M1 is disposed between the connection element 40 and the second circuit board 20. The connection element 40 is connected to the conductive layer 24 via the conductive material M1.

The fixing element 50 is disposed on the second circuit board 20, and connected to the conductive base 30 by penetrating through the second circuit board 20 and the connection element 40. In some embodiments, the fixing element 50 is conductive, and in direct contact with and electrically connected to the conductive base 30, the connection element 40, and the second circuit board 20. In some embodiments, the fixing element 50 is an insulator.

In this embodiment, the fixing element 50 is a screw fastened on the conductive base 30. The fixing element 50 includes a screw head 51 and a screw rob 52. The screw head 51 is connected to the screw rob 52, and the screw head 51 and the screw rob 52 are formed as a single piece. The screw head 51 is connected to the top surface 21 of the second circuit board 20. The screw rob 52 is in the retaining hole 332 by penetrating through the conductive hole 23 and the connection hole 43. As shown in FIG. 5, an end of the screw rob 52 is fastened on the retaining hole 332 of the conductive base 30.

In this embodiment, the conductive base 30 is fixed on the first circuit board 10, and the connection element 40 is fixed on the second circuit board 20. Therefore, when the power transmission device A50 is to be assembling, the connection element 40 is put on the conductive base 30, first. Afterwards, the fixing element 50 is fastened or fixed on the conductive base 30 after the fixing element 50 penetrates through the second circuit board 20 and the connection element 40 to complete the assembly of the power transmission device A50. Therefore, the power transmission device A50 of the present disclosure can be assembled easily.

When the power transmission device A50 is to be detached, the first circuit board 10 is easily separated from the second circuit board 20 by removing the fixing element 50. The conductive layer 24 and the conductive material M1 on the bottom surface 22 of the second circuit board 20 will no be damaged during the power transmission device A50 is to be assembled or detached. Therefore, the lifespan of the power transmission device A50 is increased.

In this embodiment, since the electrode structure (the conductive base 30, the connection element 40 and the fixing element 50) are made of rigid materials, such as metal, the electrode structure can steadily support the second circuit board 20, and separate the first circuit board 10 from the second circuit board 20. Therefore, the copper pillars in conventional art can be replaced or the number of the copper pillars can be reduced by the electrode structure of the present disclosure. The manufacturing cost of the power transmission device is decreased.

Figure 6:
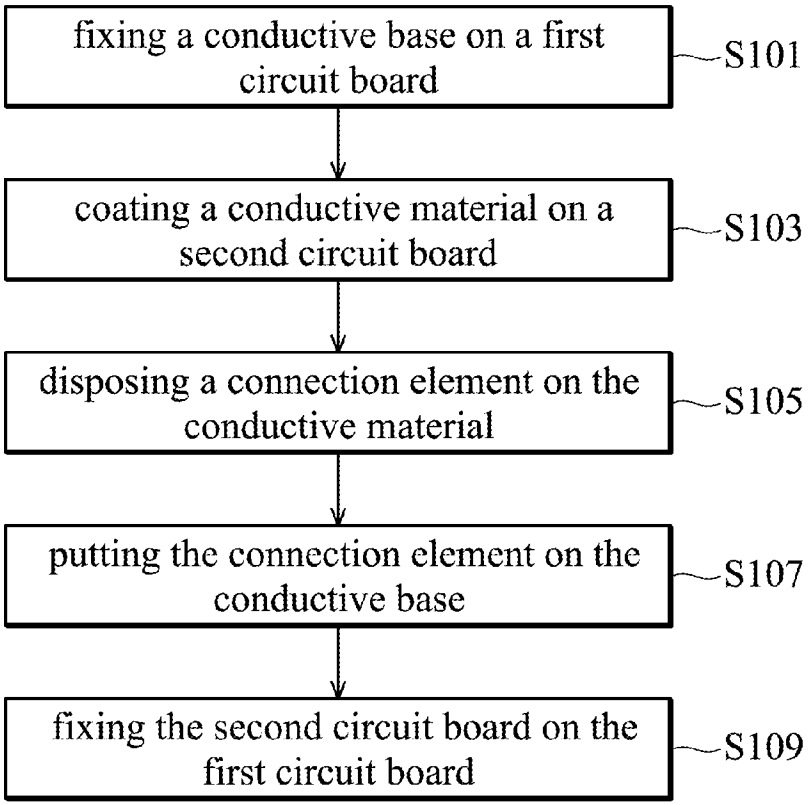
FIG. 6 is a flow chart of the manufacturing method of the power transmission device in accordance with some embodiments of the present disclosure.
Figure 7:
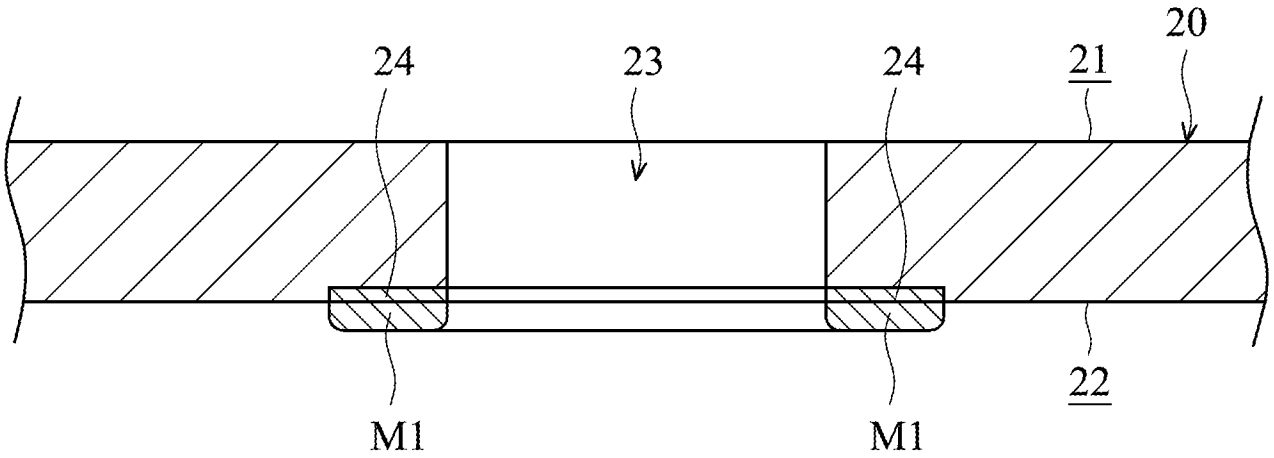
FIG. 7 is a schematic view of the manufacturing method of the power transmission device during a middle stage of the manufacturing process in accordance with some embodiments of the present disclosure.

FIG. 6 is a flow chart of the manufacturing method of the power transmission device A50 in accordance with some embodiments of the present disclosure. FIG. 7 is a schematic view of the manufacturing method of the power transmission device A50 during a middle stage of the manufacturing process in accordance with some embodiments of the present disclosure.

It should be understood that additional operations can be provided before, during, and after the method, and some of the operations described can be replaced or eliminated for other embodiments of the method.

In the S101, the first connector B10, the first electronic component B20, and the conductive base 30 are fixed on the first circuit board 10. In the step S103, as shown in FIG. 7, the conductive material M1 is coated on the conductive layer 24 of the second circuit board 20 adjacent to the conductive hole 23. At this time, the conductive material M1 is cream, molten, or liquid.

In this embodiment, the conductive layer 24 is a copper foil layer, and the conductive material M1 is a solder or conductive paste. By the conductive material M1 covering the conductive layer 24, there is no needed to plate precious metals, such as gold or silver to prevent the conductive layer 24 from oxidation. Therefore, the manufacturing cost of the power transmission device A50 is decreased.

In step S105, before the conductive material M1 in cream, molten, or liquid status is solidified, the connection element 40 is disposed on the connection element 40 (as shown in FIG. 5). Since the conductive material M1 is in cream, molten, or liquid status, the conductive material M1 is greatly connected to the connection element 40 and the conductive layer 24 of second circuit board 20.

After the conductive material M1 is solidified, the connection element 40 is fixed on the second circuit board 20 via the solidified conductive material M1. In this embodiment, the conductive material M1 is solidified by standing the second circuit board 20 for a period time, such as 1 minute.

Afterwards, the second connector B30 and the second electronic component B40 are fixed on the second circuit board 20. The step of fixing the second connector B30 and the second electronic component B40 on the second circuit board 20 can be processed before step S103.

In step S107, the connection element 40 is put on the conductive base 30. In step S109, the fixing element 50 is connected to the conductive base 30 by penetrating through the second circuit board 20 and the connection element 40. Therefore, the second circuit board 20 is fixed on the first circuit board 10 by the fixing element 50.

Figure 8:
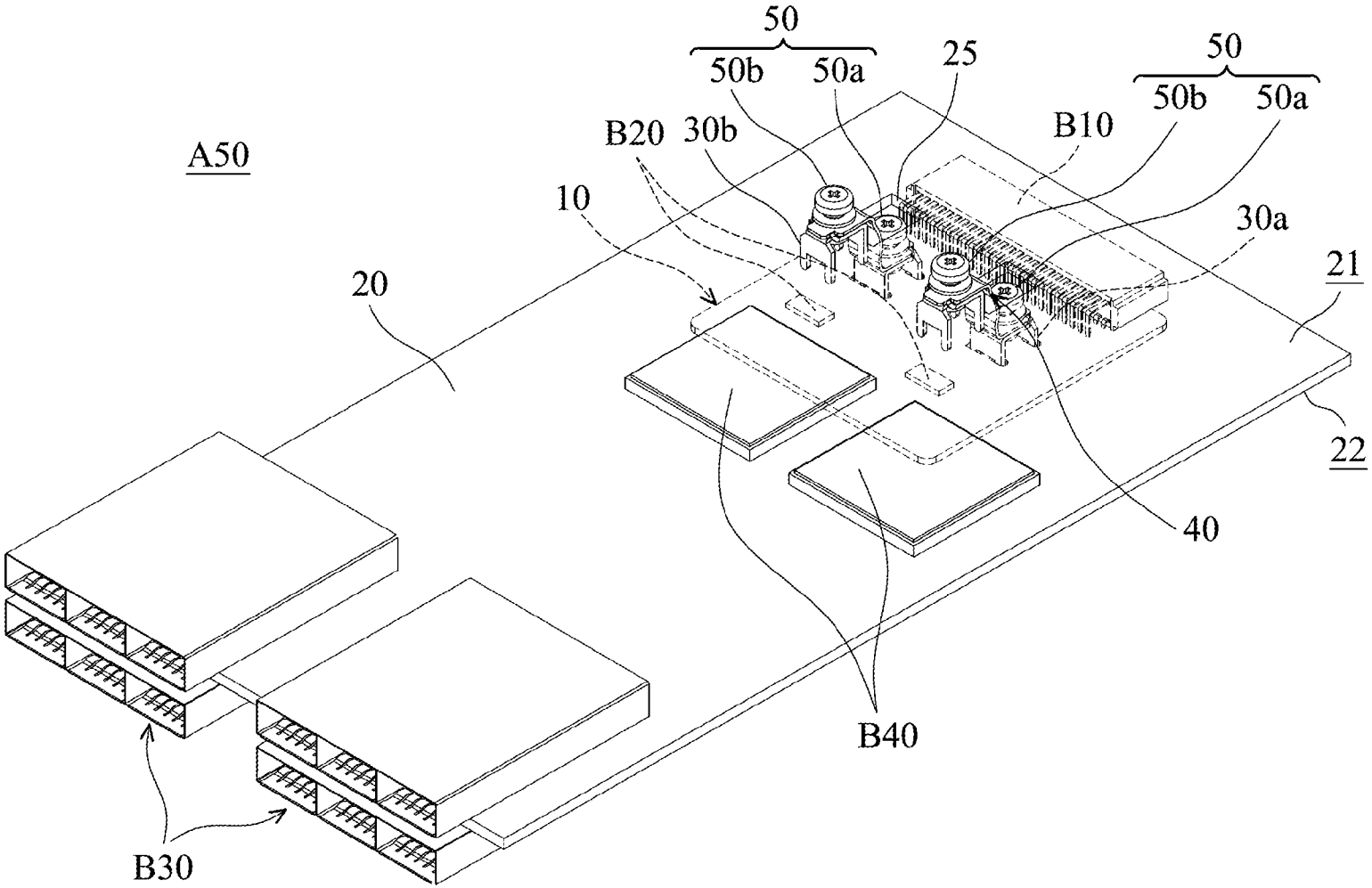
FIG. 8 is a perspective view of the power transmission device in accordance with a second embodiment of the present disclosure.
Figure 9:
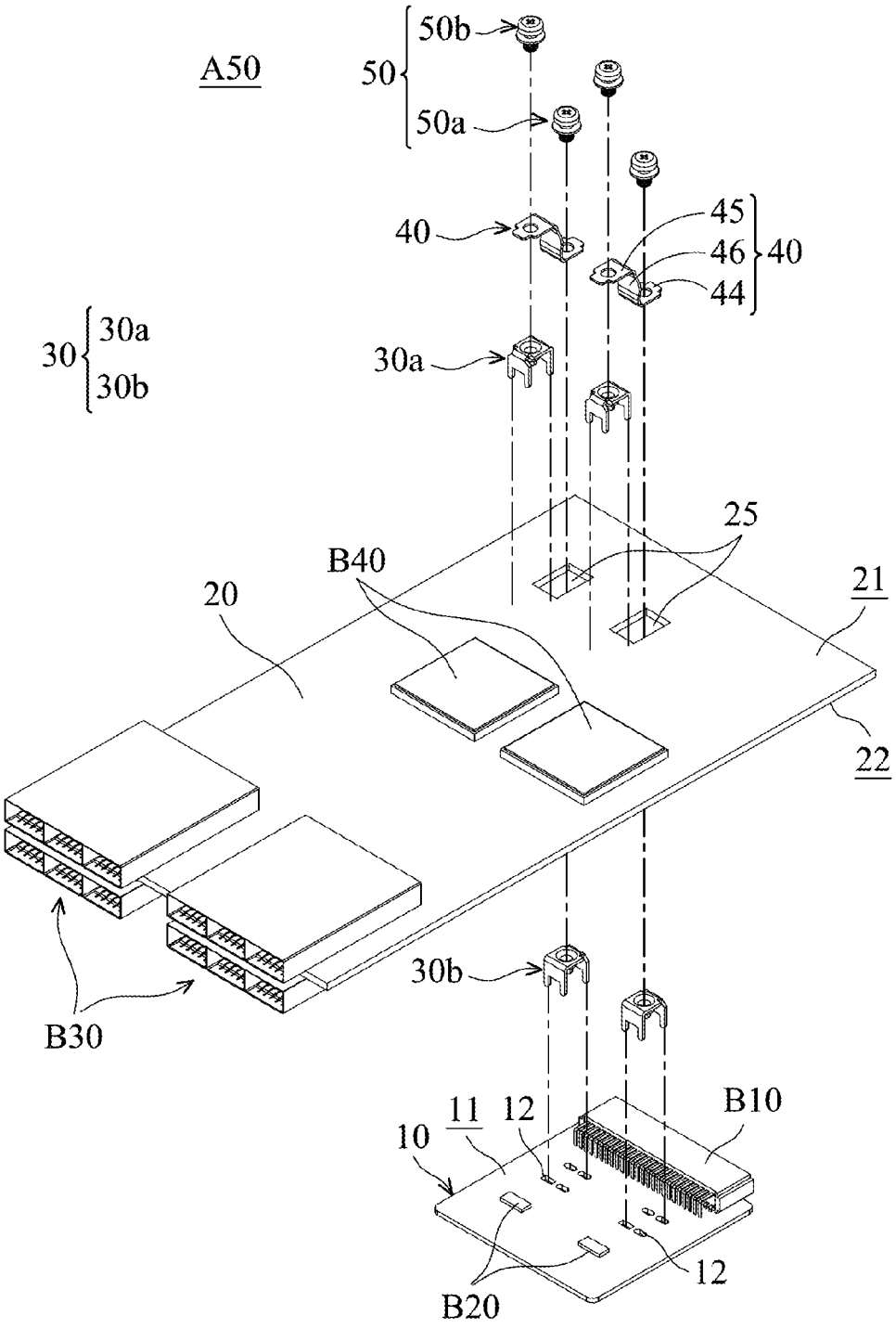
FIG. 9 is an exploded view of the power transmission device in accordance with the second embodiment of the present disclosure.
Figure 10:
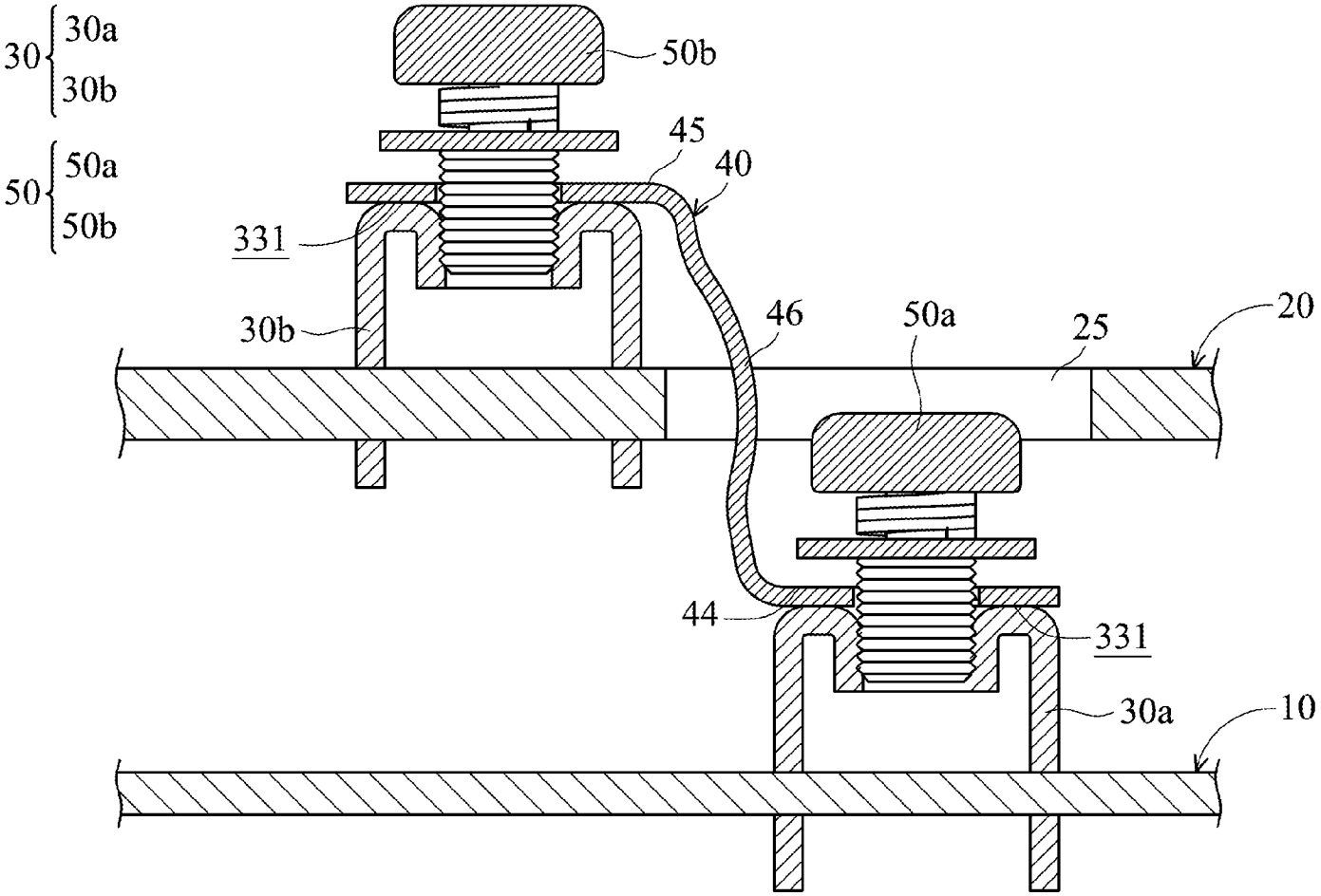
FIG. 10 is a cross-sectional view of the power transmission device in accordance with the second embodiment of the present disclosure.

FIG. 8 is a perspective view of the power transmission device A50 in accordance with a second embodiment of the present disclosure. FIG. 9 is an exploded view of the power transmission device A50 in accordance with the second embodiment of the present disclosure. FIG. 10 is a cross-sectional of the power transmission device A50 in accordance with the second embodiment of the present disclosure.

The conductive base 30 includes conductive bases 30*a* and conductive bases 30*b*. The conductive bases 30*a* are fixed on the first circuit board 10. The conductive bases 30*b* are fixed on the second circuit board 20. The second circuit board 20 is located over the first circuit board 10. The second circuit board 20 has through holes 25 adjacent to the conductive bases 30*b*.

The connection element 40 is connected to the conductive base 30*a* and the conductive base 30*b*. The first circuit board 10 is electrically connected to the second circuit board 20 via the conductive base 30*a*, the connection element 40, and the conductive base 30*b*. In this embodiment, the connection element 40 is a Z-shaped structure. The connection element 40 penetrates through the through hole 25 of the second circuit board 20, and the conductive base 30*a* is located under the through hole 25.

In this embodiment, the connection element 40 has a first connection portion 44, a second connection portion 45, and a central connection portion 46. The first connection portion 44 is connected to the top-conductive surface 331 of the conductive base 30*a*, and the second connection portion 45 is connected to the top-conductive surface 331 of the conductive base 30*b*. Moreover, the central connection portion 46 is connected to the first connection portion 44 and the second connection portion 45. The central connection portion 46 penetrates through the through hole 25.

The fixing elements 50 include the fixing element 50*a* and the fixing element 50*b*. The fixing element 50*a* penetrates through the first connection portion 44 of the connection element 40, and connected to the conductive base 30*a*. The fixing element 50*b* penetrates through the second connection portion 45 of the connection element 40, and connected to the conductive base 30*b*.

In this embodiment, the fixing element 50*a* is a screw fastened on the conductive base 30*a*, and the fixing element 50*b* is a screw fastened on the conductive base 30*b*.

In this embodiment, the fixing element 50*a* and the fixing element 50*b* are conductive. The fixing element 50*a* is in direct contact with and electrically connected to the conductive base 30*a* and the connection element 40. The fixing element 50*b* is in direct contact with and electrically connected to the conductive base 30*b* and the connection element 40.

In this embodiment, by changing the lengths of the first connection portion 44, the second connection portion 45 and/or the central connection portion 46, the connection element 40 can correspond to various designs of the first circuit boards 10 and the second circuit boards 20. In other words, the relative position between the conductive base 30*a* and the conductive base 30*b* can adjusted according to the design of the first circuit board 10 and the second circuit board 20. For example, the conductive base 30*a* may not be located under the through hole 25.

In conclusion, the power transmission device of the present disclosure utilizes the conductive base, the connection element, and the fixing element of the electrode structure to electrically connect two circuit boards, and to support the upper circuit board. Therefore, the electrical connectors that electrically connect two circuit boards in the conventional art can be replaced with the electrode structure of the present disclosure.

Moreover, the copper pillars in the conventional art can be replaced (or the number of copper pillars reduced) by the electrode structure of the present disclosure. Therefore, the manufacturing cost of the power transmission device is decreased.

The disclosed features may be combined, modified, or replaced in any suitable manner in one or more disclosed embodiments, but are not limited to any particular embodiments.

While the invention has been described by way of example and in terms of preferred embodiment, it is to be understood that the invention is not limited thereto. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A power transmission device, comprising:

a first circuit board having a first surface and a second surface opposite to the first surface;

a conductive base fixed on the first surface of the first circuit board;

a second circuit board having a first surface and a second surface opposite to the first surface of the second circuit board and facing the first surface of the first circuit board;

a connection element, disposed between the second surface of the second circuit board and the conductive base, fixed on the second surface of the second circuit board; and a fixing element, disposed on the first surface of the second circuit board, connected to the conductive base by penetrating through the second circuit board and the connection element, wherein the first circuit board is electrically connected to the second circuit board via the conductive base and the connection element.

2. The power transmission device as claimed in claim 1, further comprising a conductive material, wherein the second circuit board further comprises a conductive layer, the conductive material is disposed on the conductive layer, and the connection element is connected to the conductive layer via the conductive material.

3. The power transmission device as claimed in claim 2, wherein the conductive layer comprises a copper foil layer.

4. The power transmission device as claimed in claim 1, wherein the fixing element is a screw fastened on the conductive base.

5. The power transmission device as claimed in claim 1, wherein the fixing element is conductive, and is in direct contact with and electrically connected to the conductive base, the connection element, and the second circuit board.

6. A manufacturing method of a power transmission device, comprising:

fixing a conductive base on a first circuit board;

coating a conductive material on a conductive layer of a second circuit board and adjacent to a conductive hole of the second circuit board;

disposing a connection element on the conductive material, and fixing the connection element on the second circuit board via the conductive material;

putting the connection element on the conductive base; and fixing the second circuit board on the first circuit board by connecting the fixing element to the conductive base, wherein the fixing element penetrates through the second circuit board and the connection element, wherein the first circuit board is electrically connected to the second circuit board via the conductive base and the connection element.

7. The manufacturing method as claimed in claim 6, wherein the conductive layer is a copper foil layer.

8. The manufacturing method as claimed in claim 6, wherein the fixing element is a screw fastening on the conductive base.

9. The manufacturing method as claimed in claim 6, wherein the fixing element is a conductive material, and is in direct contact with and electrically connected to the conductive base, the connection element, and the second circuit board.

10. The manufacturing method as claimed in claim 6, further comprising:

fixing a first connector and a first electronic component on the first circuit board; and fixing a second connector and a second electronic component on the second circuit board.

11. A power transmission device, comprising:

a first circuit board having a first surface and a second surface opposite to the first surface;

a first conductive base fixed on the first surface of the first circuit board;

a second circuit board located over the first circuit board having a first surface and a second surface opposite to the first surface of the second circuit board and facing the first surface of the first circuit board;

a second conductive base fixed on the first surface of the second circuit board;

a connection element connected to the first conductive base and the second conductive base, wherein a portion of the connection element connected to the first conductive base is disposed between the second surface of the second circuit board and the first conductive base;

a first fixing element connected to the first conductive base by penetrating through the connection element; and a second fixing element connected to the second conductive base by penetrating through the connection element, wherein the first circuit board electrically connected to the second circuit board via the first conductive base, the connection element, the second conductive base.

12. The power transmission device as claimed in claim 11, wherein the first fixing element is a screw fastened on the first conductive base, and the second fixing element is a screw fastened on the second conductive base.

13. The power transmission device as claimed in claim 11, wherein the first fixing element and the second fixing element are conductive, wherein the first fixing element is in direct contact with and electrically connected to the first conductive base and the connection element, and the second fixing element is in direct contact with and electrically connected to the second conductive base and the connection element.

14. The power transmission device as claimed in claim 11, wherein the second circuit board has a through hole adjacent to the second conductive base, and the connection element penetrates through the through hole.

15. The power transmission device as claimed in claim 11, wherein the connection element comprises a first connection portion connected to the first conductive base, a second connection portion connected to the second conductive base, and a central connection portion connected to the first connection portion and the second connection portion, wherein the second circuit board comprises a through hole, and the central connection portion penetrates through the through hole.

16. The power transmission device as claimed in claim 11, wherein the connection element is a Z-shaped structure.

17. A power transmission device, comprising:

a first circuit board-;

a first conductive base fixed on-the first circuit board;

a second circuit board located over the first circuit board-;

a second conductive base fixed on-the second circuit board;

a connection element connected to the first conductive base and the second conductive base;

a first fixing element connected to the first conductive base by penetrating through the connection element; and a second fixing element connected to the second conductive base by penetrating through the connection element, wherein the first circuit board is electrically connected to the second circuit board via the first conductive base, the connection element, the second conductive base, wherein the connection element is a Z-shaped structure.

* * * * *